US008028418B2

(12) United States Patent
Sagawa

(10) Patent No.: US 8,028,418 B2
(45) Date of Patent: Oct. 4, 2011

(54) HAIR CUTTING DEVICE

(75) Inventor: Masayuki Sagawa, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 314 days.

(21) Appl. No.: 11/420,861

(22) Filed: May 30, 2006

(65) Prior Publication Data

US 2006/0265880 A1 Nov. 30, 2006

(30) Foreign Application Priority Data

May 31, 2005 (JP) ..... 2005-160313

(51) Int. Cl.
*B26B 19/00* (2006.01)
*B26B 19/02* (2006.01)
*B26B 19/12* (2006.01)

(52) U.S. Cl. ..... 30/43.92; 30/34.1; 30/43.7

(58) Field of Classification Search ..... 30/43.92, 30/43.9, 34.1, 43.7, 43.8, 43.91
See application file for complete search history.

(56) References Cited

U.S. PATENT DOCUMENTS

| | | | | |
|---|---|---|---|---|
| 3,283,185 | A * | 11/1966 | Tolmie et al. | 310/47 |
| 4,065,977 | A * | 1/1978 | Buzzi et al. | 74/49 |
| 4,292,737 | A * | 10/1981 | Packham | 30/43.92 |
| 4,711,028 | A * | 12/1987 | Bergsma et al. | 30/43.6 |
| 6,317,982 | B1 * | 11/2001 | Andrew | 30/34.1 |
| 6,892,457 | B2 * | 5/2005 | Shiba et al. | 30/43.92 |
| 7,020,966 | B2 | 4/2006 | Shiba et al. | |
| 7,464,471 | B2 * | 12/2008 | Fukutani et al. | 30/43.91 |
| 2004/0010919 | A1 | 1/2004 | Shiba et al. | |
| 2005/0016002 | A1 | 1/2005 | Fukutani et al. | |
| 2005/0229400 | A1 | 10/2005 | Yamaguchi et al. | |
| 2006/0021228 | A1 * | 2/2006 | Shiba et al. | 30/43.92 |

FOREIGN PATENT DOCUMENTS

| | | |
|---|---|---|
| EP | 1375089 | 1/2004 |
| JP | 2003-210871 | 7/2003 |
| JP | 2004-16519 | 1/2004 |
| KR | 10-2004-0062619 | 7/2004 |
| WO | 03/041918 | 5/2003 |

OTHER PUBLICATIONS

English Language Abstract of JP 2003-210871.
U.S. Appl. No. 11/420,899 to Sagawa et al., filed May 30, 2006.

* cited by examiner

*Primary Examiner* — Ghassem Alie
*Assistant Examiner* — Bharat C Patel
(74) *Attorney, Agent, or Firm* — Greenblum & Bernstein, P.L.C.

(57) ABSTRACT

In a hair cutting device, a head portion is connected such that the head portion can laterally tilt and vertically move. The head portion is stably supported in a front-rear direction, connected to an upper portion of a main body grip portion, and resiliently biased upward. An upper end of the main body grip portion is formed with an opened space into which a lower portion of the head portion is inserted. Front and back surfaces of the head portion have a pair of left and right shaft portions which are connected to an inner surface of the opened space such that the shaft portions can turn and vertically move and come into slide contact with the inner surface of the opened space. A contact portion which is provided lower than the pair of shaft portions comes into slide contact with the inner surface of the opened space.

7 Claims, 13 Drawing Sheets

HAIR CUTTING DEVICE

CROSS REFERENCE TO RELATED APPLICATION

This application is based upon and claims the benefit of priority from a Japanese Patent Application No. TOKUGAN 2005-160313, filed on May 31, 2005, the entire contents of which are incorporated herein by reference.

BACKGROUND OF THE INVENTION

1. Field of the Invention

The present invention relates to a hair cutting device in which a head portion is connected to an upper portion of a main body grip portion such that the head portion can laterally tilt and vertically move.

2. Description of the Related Art

Conventionally, there is a known hair cutting device in which a head portion having an outer blade formed with a plurality of blade holes, an inner blade which comes into slide contact with an inner surface of the outer blade, and a motor which drives the inner blade is connected to an upper portion of a main body grip portion having a controller such that the head portion can laterally tilt and vertically move, and the head portion is resiliently biased upward (Japanese Patent Application Laid-open No. 2003-210871).

However, the hair cutting device includes a pair of U-shaped connecting members for connecting the head portion and the main body grip portion with each other, upper ends of the connecting members are turnably connected to the head portion, and lower ends of the connecting members are connected to the main body grip portion such that the connecting members can vertically move and are resiliently biased upward. A large gap is formed between the head portion and the main body grip portion. Therefore, there is a problem that positioning of the head portion in the front-rear direction becomes unstable, and this causes noise. Furthermore, there is also a problem that the number of parts such as the connecting members is increased and the cost is also increased.

SUMMARY OF THE INVENTION

The present invention has been achieved in view of the above problem, and it is an object of the invention to provide a hair cutting device in which a head portion is connected to an upper portion of a main body grip portion such that the head portion can laterally tilt and vertically move, the head portion is stably supported in the front-rear direction, noise is restrained from being generated, and the number of parts is reduced.

To solve the above problem, the present invention provides a hair cutting device in which a head portion including an outer blade formed with a plurality of blade holes, an inner blade which comes into slide contact with an inner surface of the outer blade, and a motor which drives the inner blade is connected to an upper portion of a main body grip portion having a controller such that the head portion can laterally tilt and vertically move, the head portion is resiliently biased upward, wherein an upper end of the main body grip portion is formed with an opened space into which a lower portion of the head portion is inserted, both front and back surfaces of the head portion have a pair of left and right shaft portions which are connected to an inner surface of the opened space of the main body grip portion such that the shaft portions can turn and vertically move and which come into slide contact with an inner surface of the opened space, and a contact portion which is provided lower than the pair of shaft portions and which comes into slide contact with the inner surface of the opened space.

According to the hair cutting device having the above-described structure, if the head portion is straightly pushed into the main body grip portion, the head portion sinks into the main body grip portion against the upward resilience biasing force, and if the head portion is pushed into left or right side, the head portion turns and tilts around the shaft portion located on the other side. Here, in both the front and rear surfaces of the head portion, the head portion comes into slide contact with the main body grip portion at three portions, i.e., the pair of shaft portions and the contact portion. Therefore, the head portion is stably supported in the front-rear direction, and noise is suppressed. In addition, the head portion and the main body grip portion are in direct contact with each other and no special member is interposed therebetween, the number of required parts is small, it becomes easy to assemble the hair cutting device, and the cost is reduced.

In the hair cutting device, it is preferable that an annular member is mounted on an outer surface of the lower portion of the head portion, a pair of left and right shaft portions respectively provided on both front and back surfaces of the annular member are supported by a bearing formed on an inner surface of the opened space of the main body grip portion such that the shaft portions can turn and vertically move, spring receivers respectively provided on left and right ends of the annular member receive push-up spring which resiliently biases the head portion upward. With this configuration, the shaft portions on both the front and back surfaces and the spring receivers on both the left and right ends can be mounted on the head portion only by mounting the annular member. Therefore, it becomes easy to assemble the above-described parts, and the number of parts to be mounted is reduced.

It is preferable that the lower portion of the head portion is formed as a box-like accommodating body in which the motor is accommodated, a pair of shaft portions are disposed on an upper end of the accommodating body, and a contact portion is disposed on a lower end of the accommodating body. If the shaft portions and the contact portion are disposed on upper and lower ends of the vertically long accommodating body in which the motor is accommodated in this manner, a distance between the shaft portions and the contact portion which are rotation centers is secured and the head portion can stably be held.

In this case, it is preferable that the head portion and the main body grip portion have waterproof structures which are independent from each other, a through hole formed in the accommodating body of the head portion and a through hole formed in the opened space of the main body grip portion are water-tightly connected to each other through a waterproof tube, a wire for electrically connecting the motor in the accommodating body of the head portion and the controller in the main body grip portion with each other is inserted into the waterproof tube, the contact portion provided at least one of the front and back surfaces of the head portion is integrally formed together with a detent member of the waterproof tube. With this configuration, it is possible to reduce the number of parts, to make the assembling easy, and to reduce the costs.

It is preferable that the detent member is inserted into and fixed to the accommodating body in a direction perpendicular to a sliding surface of the contact portion. With this configuration, the detent member is always pushed from a direction in which that member is pulled out. Thus, it is possible to prevent a part from failing by an impact at the time of falling and during long term usage.

In the hair cutting device, it is preferable that the shaft portion and the contact portion provided on the head portion are made of a material different from a material of the opened space of the main body grip portion. With this configuration, friction force between the main body grip portions can be reduced, and the head portion can smoothly laterally tilt and vertically move. Furthermore, wear resistances of the shaft portion and the contact portion can be enhanced.

The above-described structures can appropriately be combined without departing from the scope of the present invention.

DETAILED DESCRIPTION OF THE PREFERRED EMBODIMENTS

Figure 1:
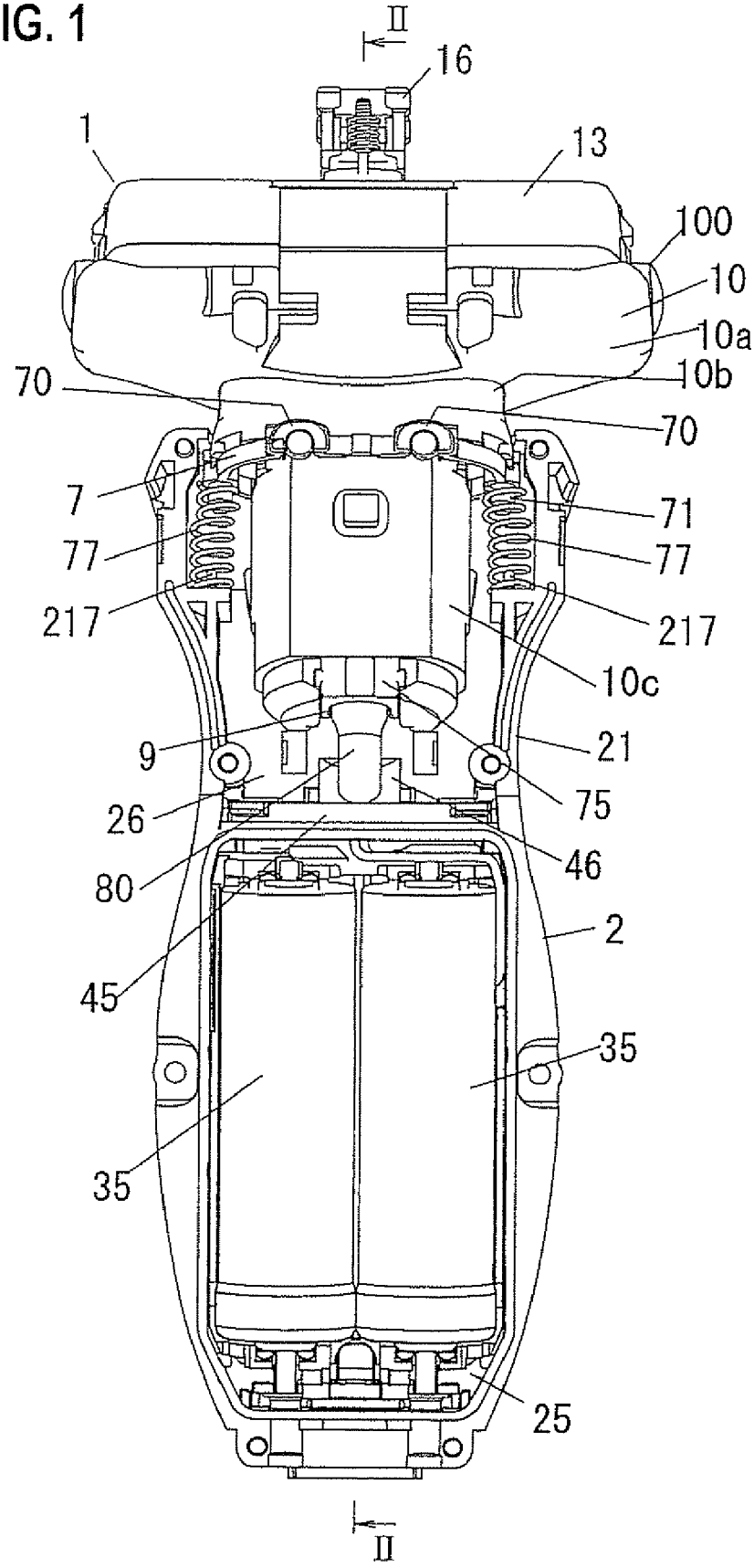
FIG. 1 is a rear view of a state in which a rear housing and a holding frame of a hair cutting device according to one example of an embodiment of the present invention are removed.

The present invention is explained below based on embodiments shown in the accompanying drawings. A hair cutting device shown in the drawings is an electric shaver including a head portion 1 and a main body grip portion 2. The head portion 1 is provided at its upper end surface with a plurality of blade blocks 3 and 3. The main body grip portion 2 holds and resiliently biases the head portion 1 upward such that the head portion 1 can vertically move and laterally tilt. As shown in FIGS. 5 to 7 and 12, the head portion 1 includes a laterally wide base portion 10, a holding frame 11 which is detachably disposed on the base portion 10, and a mounting frame 12 which can be attached to and detachable from the holding frame 11. The blade blocks 3 and 3 are mounted on the mounting frame 12. A reference numeral 100 in the drawings represents a button of the mounting frame 12 for attaching and detaching. In this specification, in a relation between the head portion 1 and the main body grip portion 2, a direction on a side where the head portion 1 is located is the upside, a direction on a side where the main body grip portion 2 is located is the downside, a direction perpendicular to the vertical direction at right angles and along which a later-described inner blade 30 is reciprocated is the lateral direction, and a direction perpendicular to the vertical direction and the lateral direction at right angles is the front-rear direction.

Figure 12:
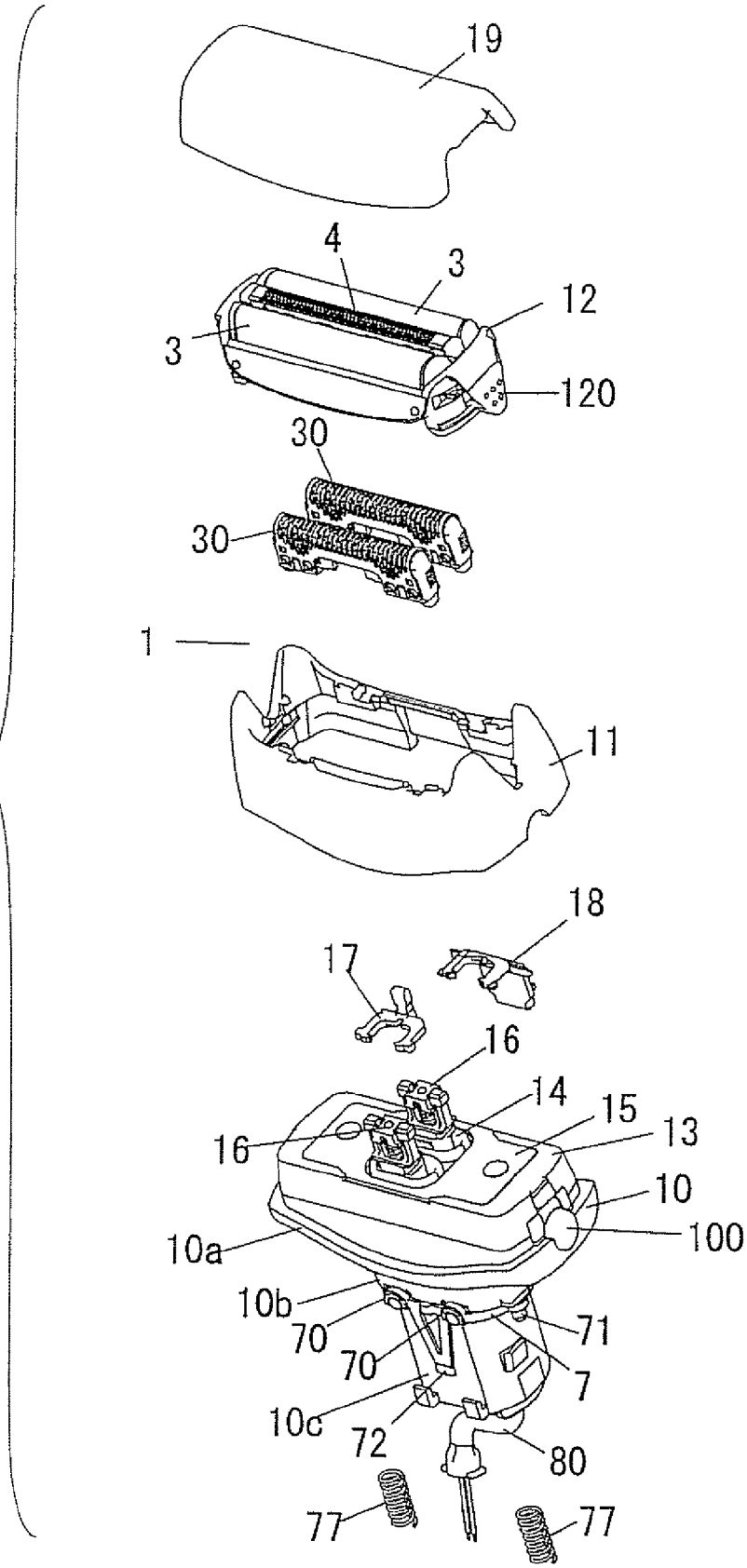
FIG. 12 is an exploded perspective view of the head portion of the example.

The base portion 10 includes a wide portion 10*a* which is laterally wide and which forms an upper portion of the base portion 10, an accommodating body 10*c* which is laterally narrow box-like portion and which forms a lower portion of the base portion 10, and a neck portion 10*b* which is located between both the portions 10*a* and 10*c* and which forms an intermediate portion of the base portion 10. An opening of the upper end surface of the wide portion 10*a* is closed with a cover 13 shown in FIG. 12. Portions of a pair of drive elements 16 and 16 disposed in the wide portion 10*a* of the base portion 10 are inserted into a central portion of the cover 13, and the portions project upward. In FIG. 12, a reference numeral 14 represents a waterproof rubber for making the inserting portion waterproof, and a reference numeral 15 represents a fixing plate for fixing the waterproof rubber 14.

The drive elements 16 and 16 accommodated in the wide portion 10*a* of the base portion 10 receive rotation output of a motor 8 accommodated in the accommodating body 10*c* through eccentric shafts 81 and 82 and convert the same into lateral reciprocating motion. Inner blades 30 and 30 are respectively connected to portions of the drive elements 16 and 16 projecting upward from the cover 13. The inner blades 30 and 30 are located such as to be pressed by an inner surface of outer blades 6 mounted on upper ends of the corresponding blade blocks 3 and 3. If the inner blades 30 and 30 are laterally provided with the drive elements 16 and 16 and reciprocated laterally, the inner blades 30 and 30 come into slide contact with an inner surface of the outer blade 6, and hair introduced from a plurality of blade holes formed in the outer blade 6 is cut. A connecting element 17 for reciprocating the inner blade of the blade head 4 is mounted on one of the pair of drive elements 16 and 16. A connecting element 18 for driving the trimmer blade block 5 is mounted on the other drive element 16. A reference numeral 19 in FIG. 12 represents a blade protection cover.

Figure 11:
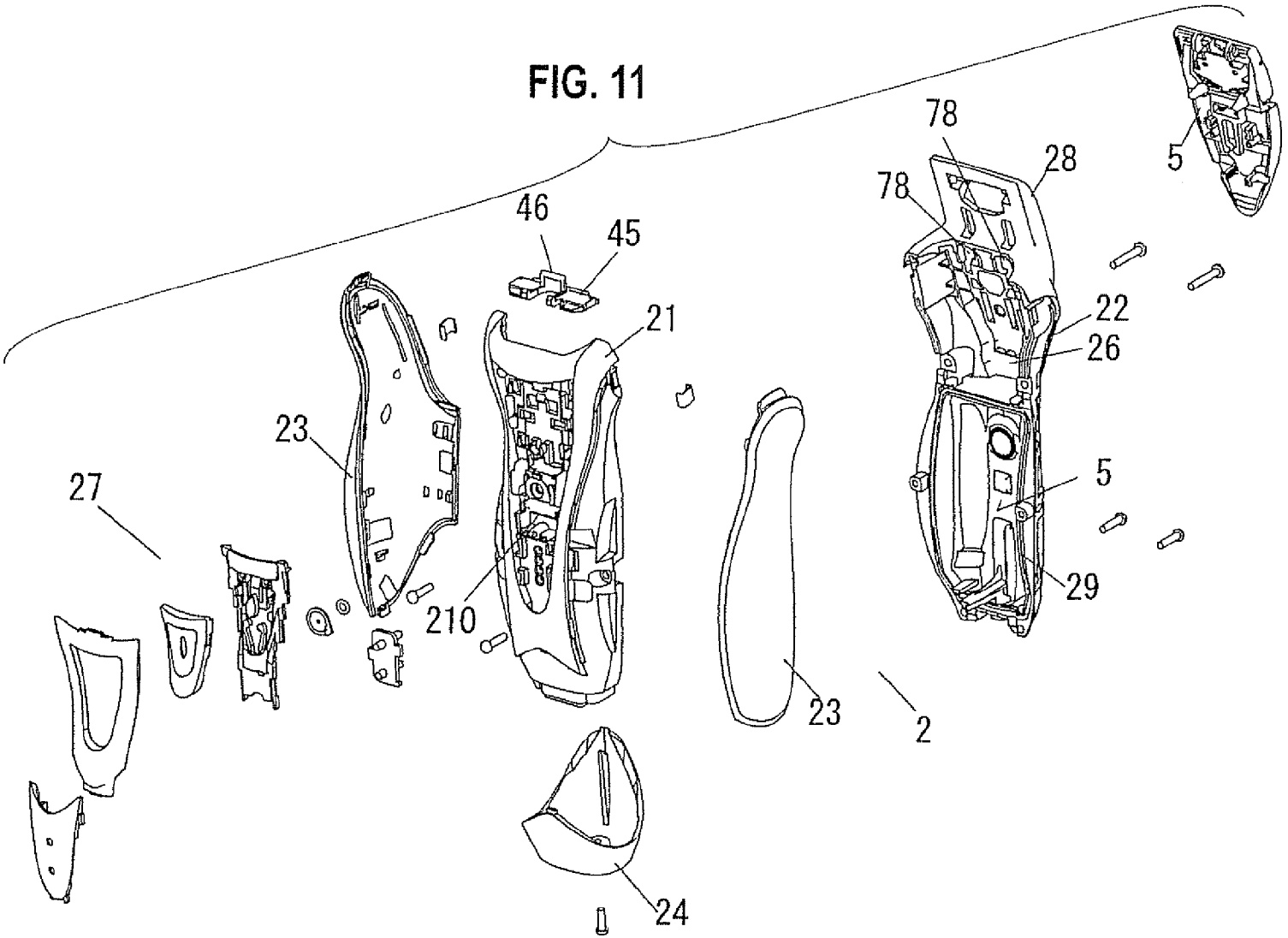
FIG. 11 is an exploded perspective view of a hull portion of a main body grip portion of the example.

As shown in FIG. 11, the main body grip portion 2 includes front-rearly divided a front housing 21 and a rear housing 22, non-slip covers 23 and 23 which are put on left and right side surfaces of the housings 21 and 22, and a lower cover 24 which is put on lower ends of the housings 21 and 22. A switch block 27 is disposed on a front surface of the main body grip portion 2, and a trimmer blade block 5 is located on a back surface of the main body grip portion 2. The trimmer blade blocks is disposed on an outer surface of a support piece 28 which rises from an upper portion of the rear housing 22. If a handle portion formed on a lower side is slid upward, an upper blade portion turns and projects. At that time, the trimmer blade block 5 is connected to the connecting element 18 and the reciprocating motion is transmitted.

Figure 8:
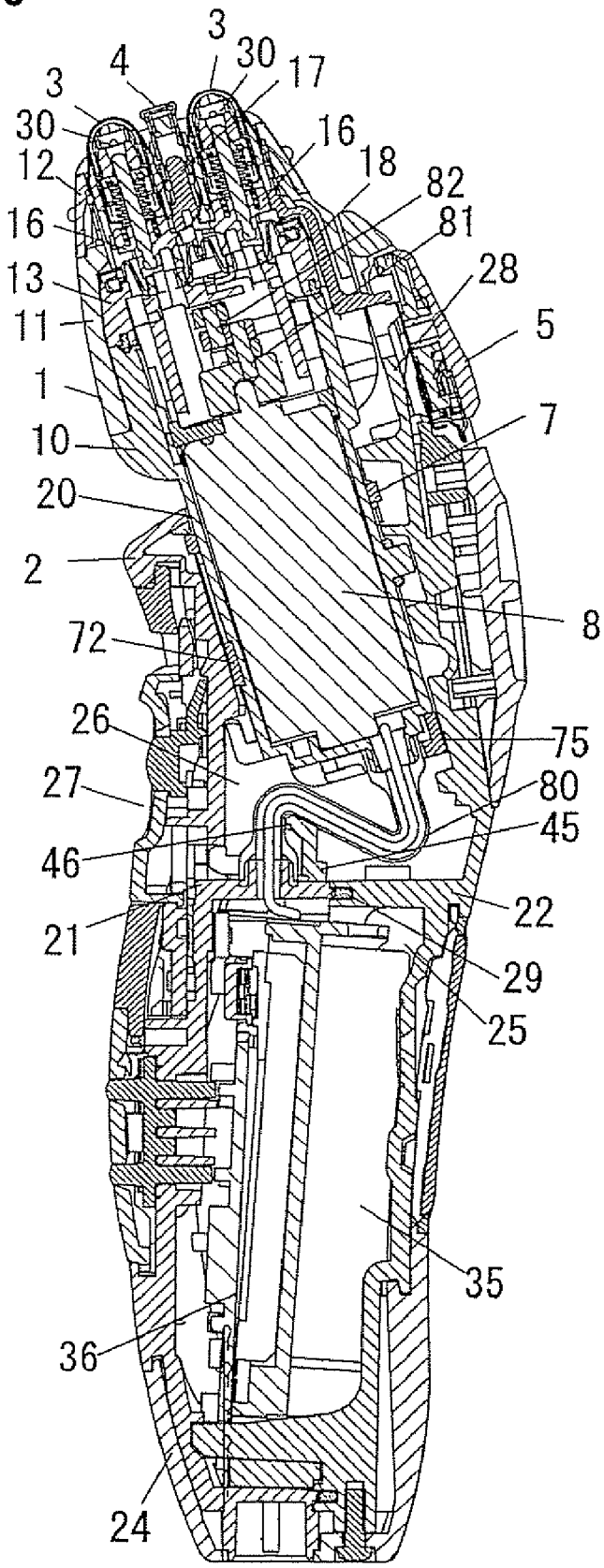
FIG. 8 is a sectional view taken along the line B-B in FIG. 3.

An interior space of the main body grip portion 2 is divided into two spaces, i.e., an upper opened space 26 and a hermetic space 25 forming a lower portion. A secondary battery 35 and a controller 36 including a circuit block shown in FIG. 8 are accommodated in the hermetic space 25 which is made waterproof by an O-ring 29.

The opened space 26 is formed in an upper portion of the main body grip portion 2. The entire accommodating body 10*c* in the head portion 1 is inserted and accommodated in the opened space 26 from above. The opened space 26 supports the head portion 1 such that the head portion 1 can vertically move and laterally tilt. The opened space 26 is provided at its inner surface with a pair of left and right groove-like bearings 78 and 78 which receive a pair of left and right shaft portions 70 and 70 provided on front and rear surfaces of the upper end of the accommodating body 10*c*. The front housing 21 is provided at its inner surface with spring receivers 217 and 217 which receive lower ends of a pair of left and right push-up springs 77 and 77. The bearings 78 and 78 permits rotations and vertical motions of the shaft portions 70 and 70.

Upper ends of the push-up springs 77 and 77 are received by the spring receivers 71 and 71 located on left and right lower end surface of the neck portion 10*b* in the head portion 1. Thus, the head portion 1 is resiliently biased upward by the push-up springs 77 and 77.

In the above structure, if the head portion 1 is pushed in the main body grip portion 2, the head portion 1 sinks into the main body grip portion 2 against the biasing forces from the push-up springs 77 and 77. If one of the left and right sides of the head portion 1 is pushed in, the head portion 1 is turned and tilted while compressing the one push-up spring 77 around the shaft portion 70 located on the other side. The spring receivers 71 and 71 which receive the resiliently biasing force of the push-up spring 77 are located on the outer sides in the lateral direction as compared with the pair of shaft portions 70 and 70. Therefore, the head portion 1 is smoothly turned around the one shaft portion 70 when it is laterally tilted.

Portions of the head portion 1 which come into contact with the main body grip portion 2 are limited to three portions of the front surface and three portions of the accommodating body 10*c* so as to make the above-described motion of the head portion 1 smooth and not to generate rattle. The three portions of the front surface are the two shaft portions 70 and 70 located on left and right sides of the upper end of the accommodating body 10*c* and a contact portion 75 located on the lower end of the accommodating body 10*c*. The three portions of the back surface are the two shaft portions 70 and 70 located on left and right sides of the upper end of the accommodating body 10*c* and the contact portion 72 located on a lower end of the accommodating body 10*c*. When the head portion 1 is vertically moved and tilted, the three front contact portions and the three rear contact portions come into slide contact with the inner surfaces of the front and rear housing 21 and 22, and the motion is guided. The shaft portions 70 and 70 and the contact portions 72 and 75 are disposed on upper and lower ends of the vertically long accommodating body 10*c* in which the motor 8 is accommodated. With this configuration, a distance is secured between the shaft portions 70 and 70 and the contact portions 72 and 75 which are rotation centers in both front and rear surfaces, and the head portion 1 is held stably.

When members made of the same material slide against each other, they are worn abruptly. Therefore, such members are made of polyoxymethylene resin (Duracon) or the like, and an annular member 7 mounted on the base portion 10 of the head portion 1 is provided with the four shaft portions 70 and contact portion 72. The contact portion 75 is also made of polyoxymethylene resin (Duracon), and is mounted on a lower end of the front surface of the accommodating body 10*c*.

Figure 13:
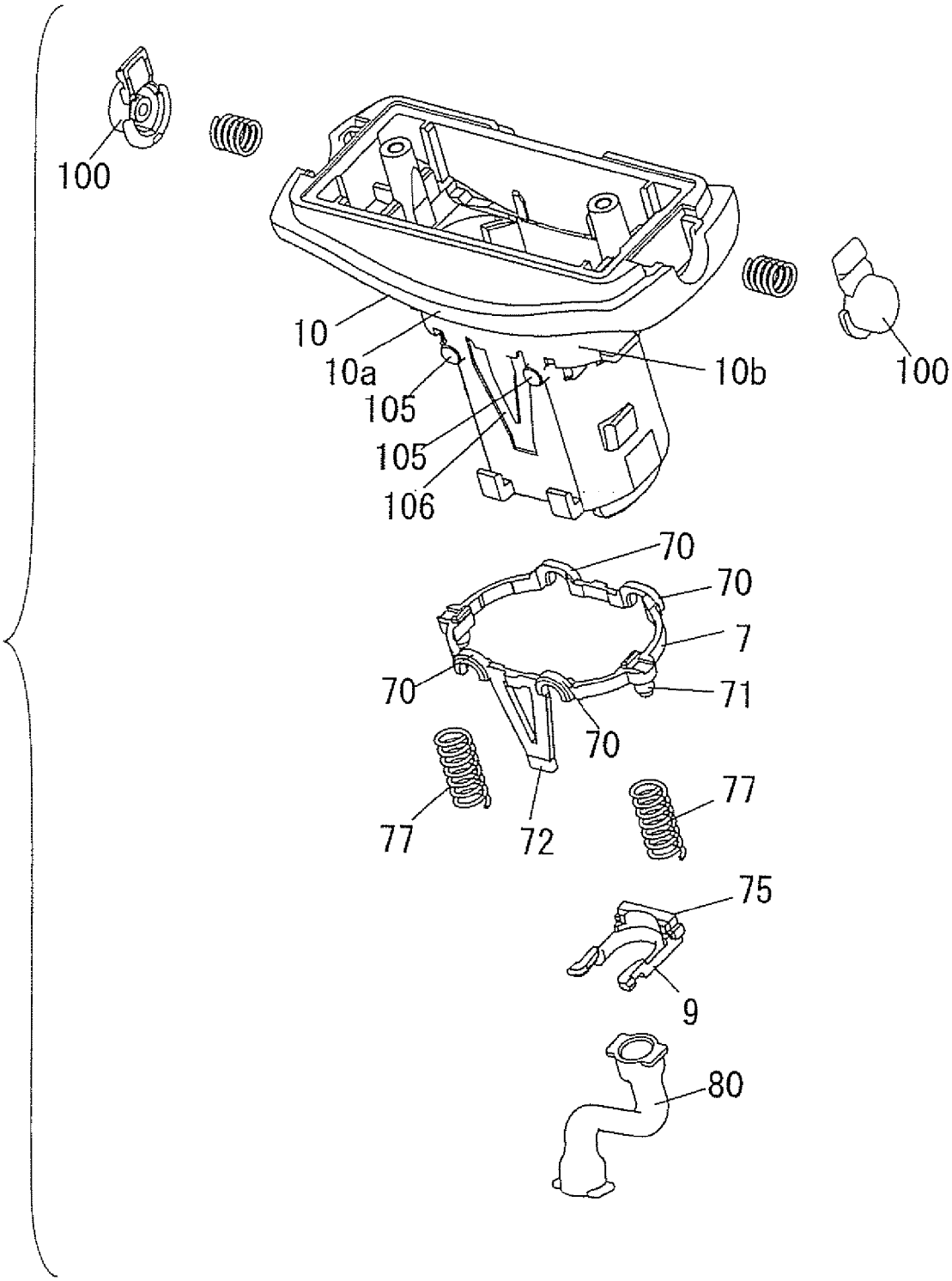
FIG. 13 is an exploded perspective view of a base portion of the head portion.

The annular member 7 is integrally provided with spring receivers 71 and 71 which receive the push-up spring 77 in addition to the four shaft portions 70 and the contact portion 72 as described above. The annular member 7 is mounted on the base portion 10 from the accommodating body 10*c* utilizing resilience of the annular member 7 and margin caused by the gap generated between the portions of the annular member 7 which have the spring receivers 71 and 71 and the accommodating body 10*c*. The annular member 7 is positioned and fixed to the base portion 10 by a boss 105 projects from the accommodating body 10*c* so as to engage the inner side of the shaft portion 70, a groove 106 (see FIG. 13) formed in the accommodating body 10*c* into which the contact portion 72 is fitted, and a lower end surface of the neck portion 10*b*.

The contact portion 75 is formed as a member which is independent from the annular member 7. The contact portion 75 is integrally formed on a detent member 9. A wire which connects the motor 8 in the head portion 1 and the controller 36 in the main body grip portion 2 is inserted through a waterproof tube 80. An end of the waterproof tube 80 is fixed to the head portion 1 by the detent member 9. The head portion 1 and the main body grip portion 2 have waterproof structures which are independent from each other. A through hole formed in a lower end surface of the accommodating body 10*c* of the head portion 1 and a through hole formed in a bottom surface of the opened space 26 of the main body grip portion 2 are water-tightly connected to each other through the waterproof tube 80.

An end of the waterproof tube 80 on the side of the main body grip portion 2 is sandwiched and fixed between the partition wall and the pressure plate 45 which is disposed on and fixed to the partition wall between the hermetic space 25 and the opened space 26. A rib 46 rises from the pressure plate 45. The waterproof tube 80 is led out from a lower end surface of the accommodating body 10*c* accommodated in the opened space 26 such that the accommodating body 10*c* can move. The rib 46 provides the waterproof tube 80 with necessary bending state.

Figure 2:
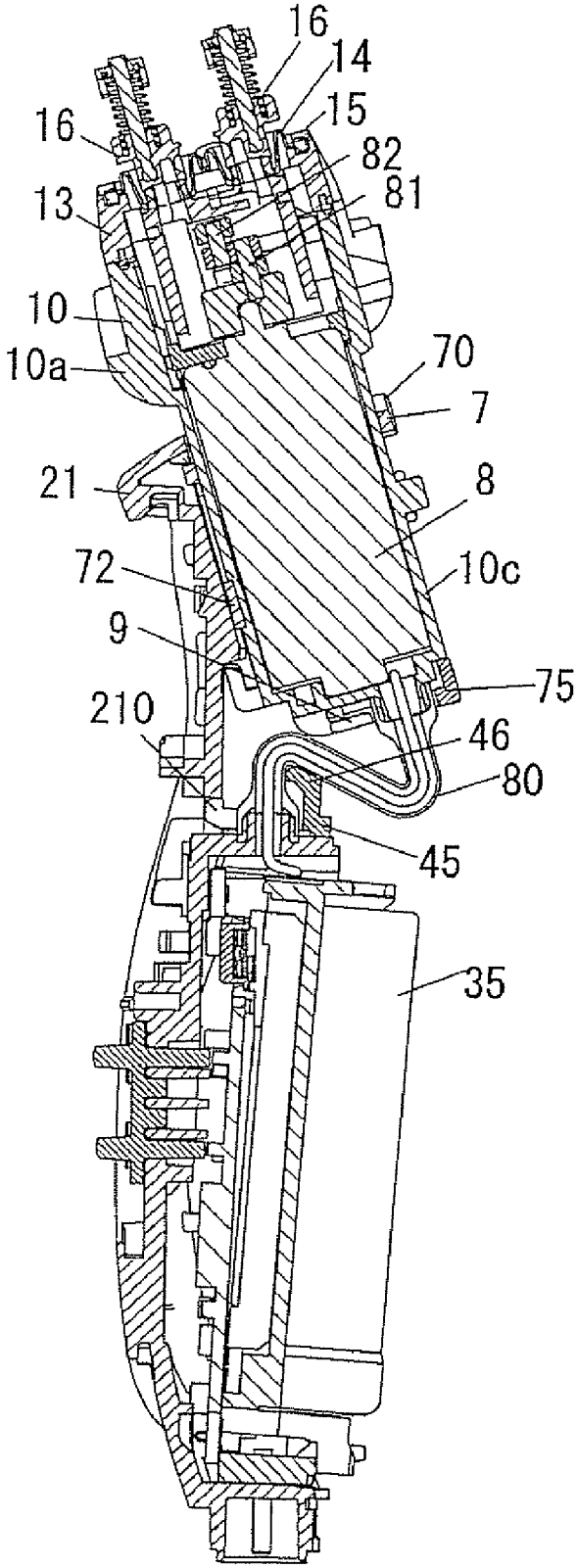
FIG. 2 is a sectional view taken along the line A-A in FIG. 1.
Figure 3:
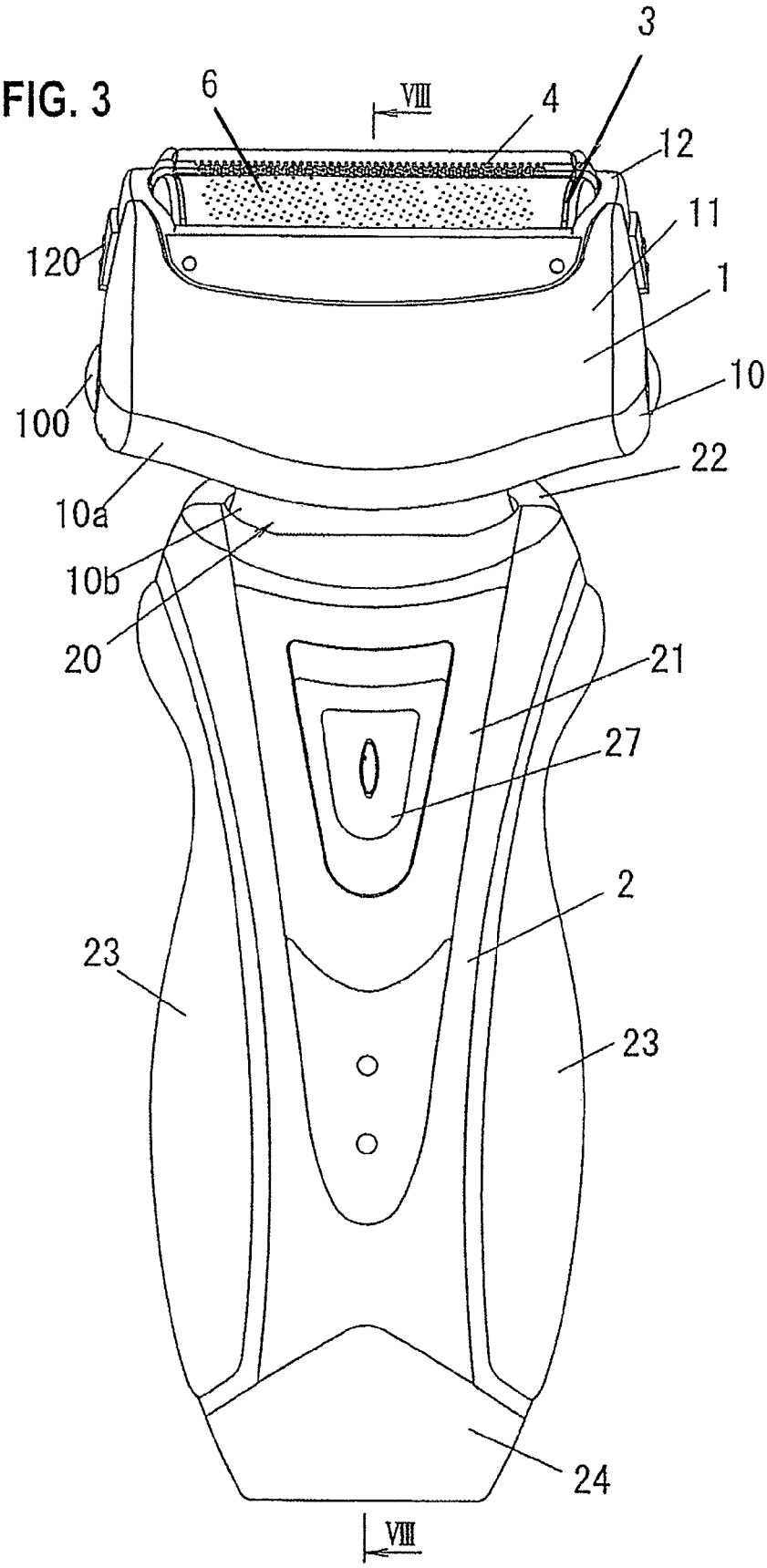
FIG. 3 is a front view of the hair cutting device.
Figure 4:
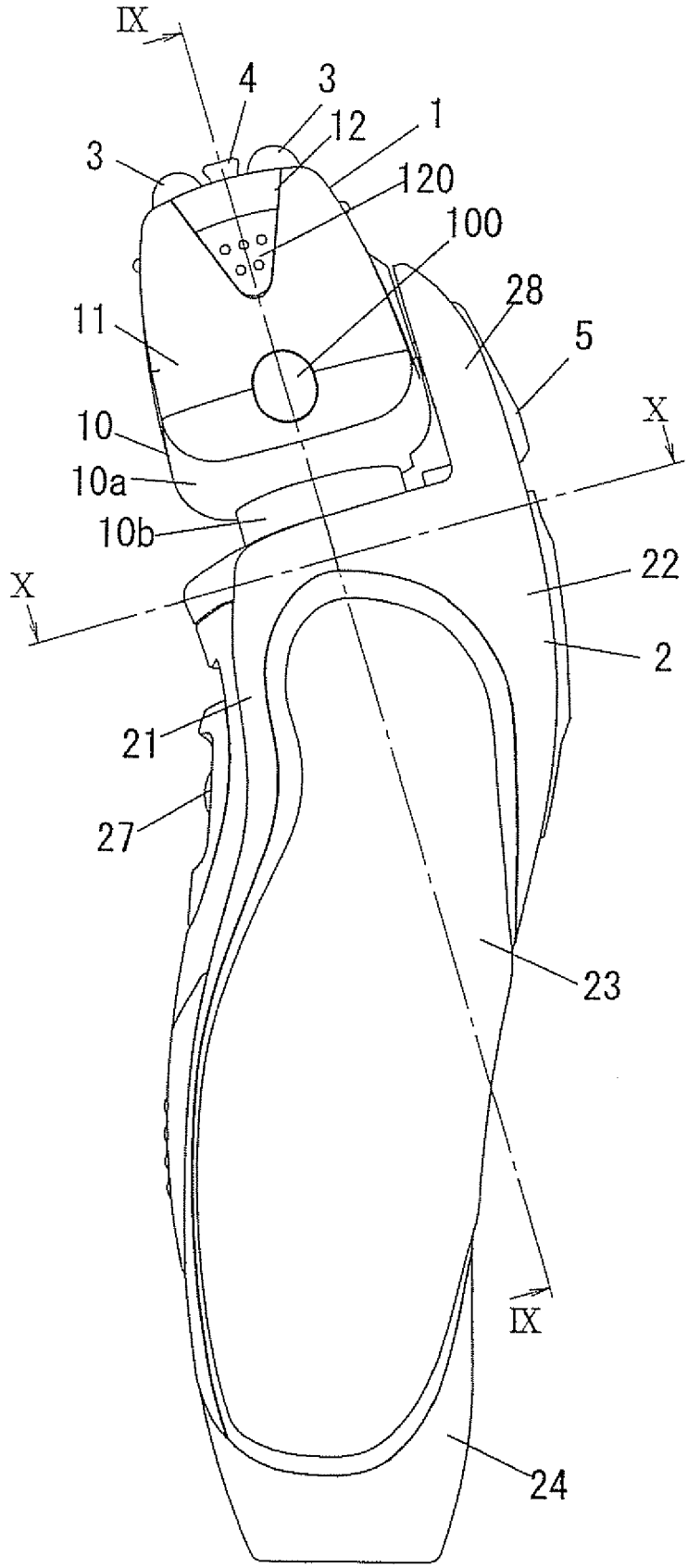
FIG. 4 is a side view of the hair cutting device.
Figure 5:
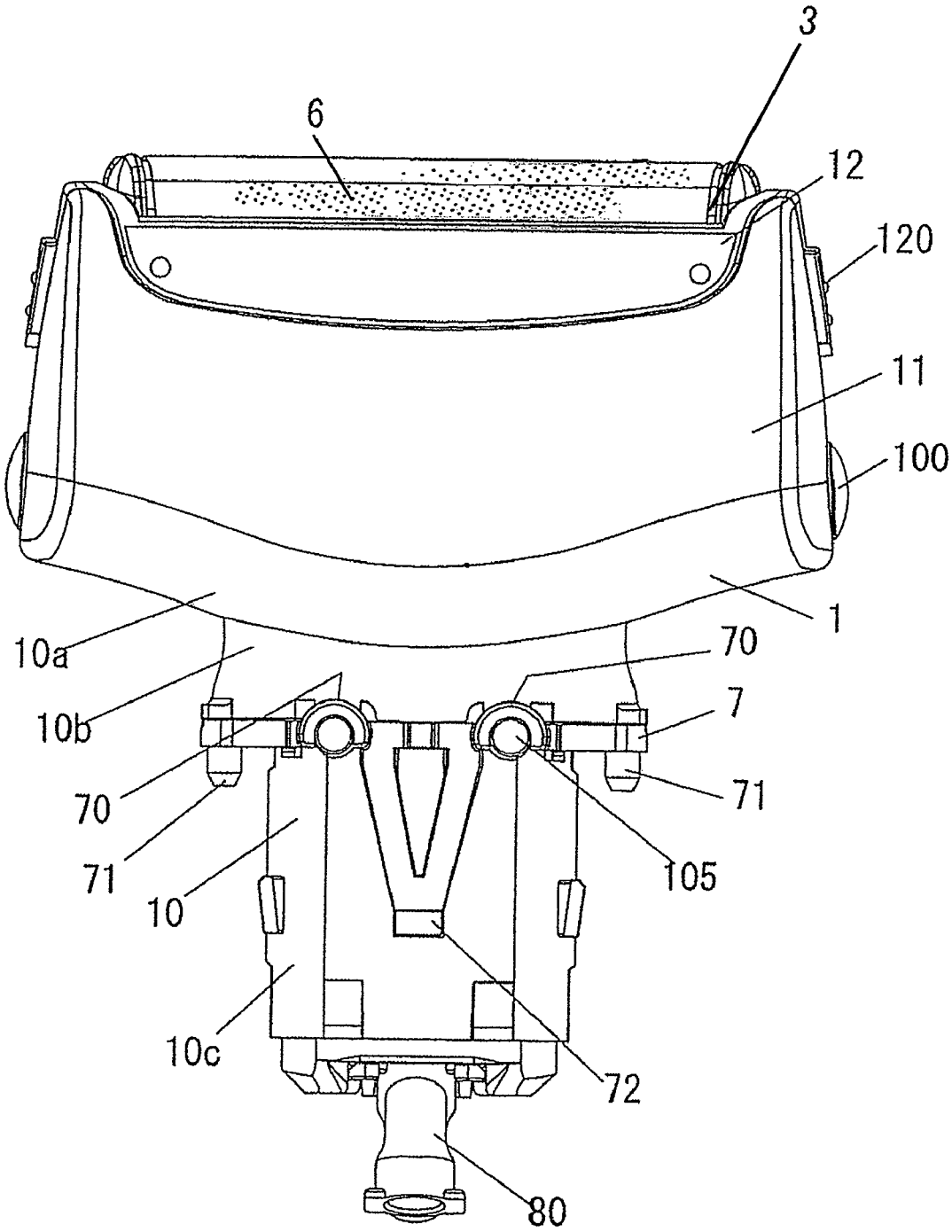
FIG. 5 is a front view of a head portion of the example.
Figure 6:
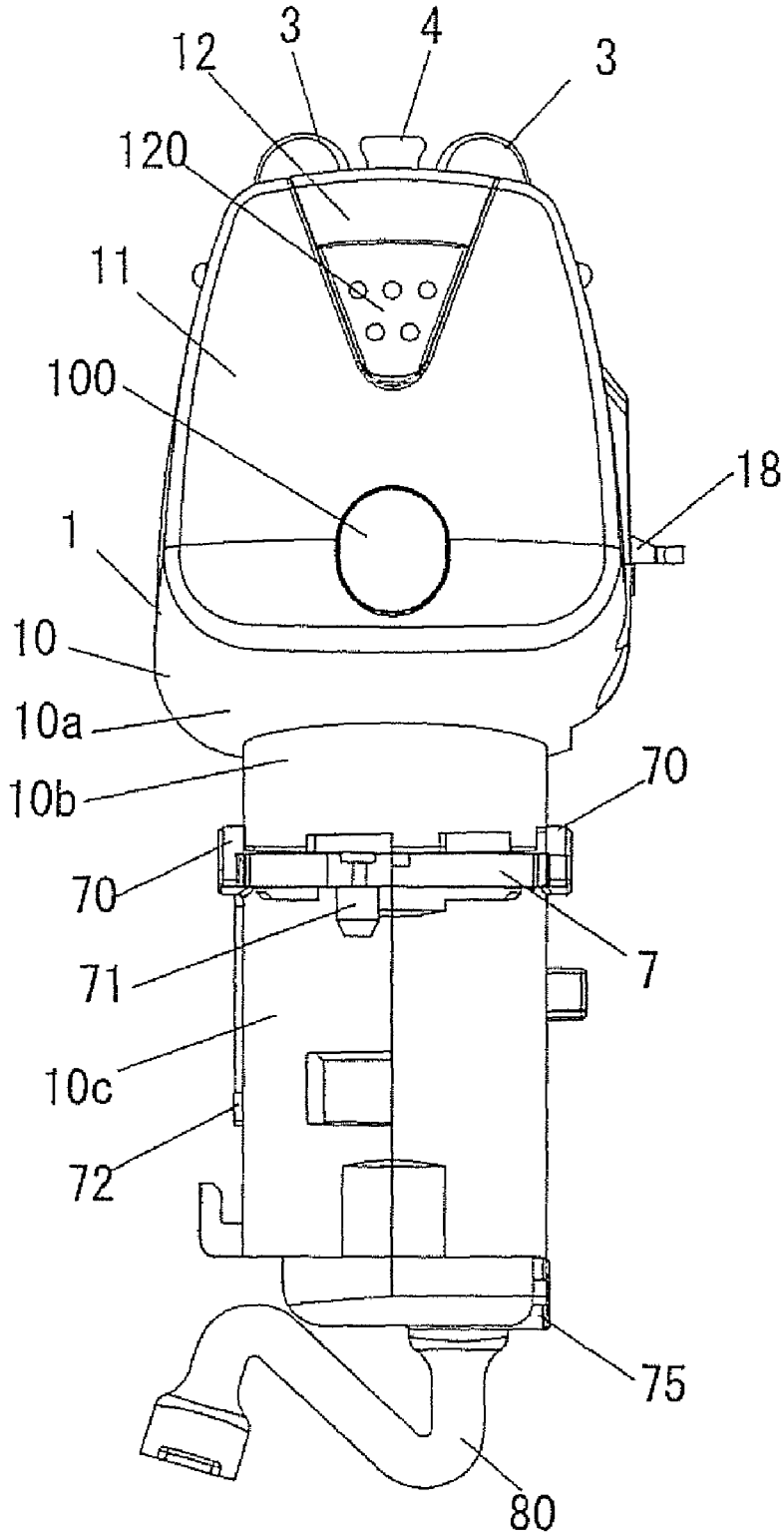
FIG. 6 is a side view of the head portion.
Figure 7:
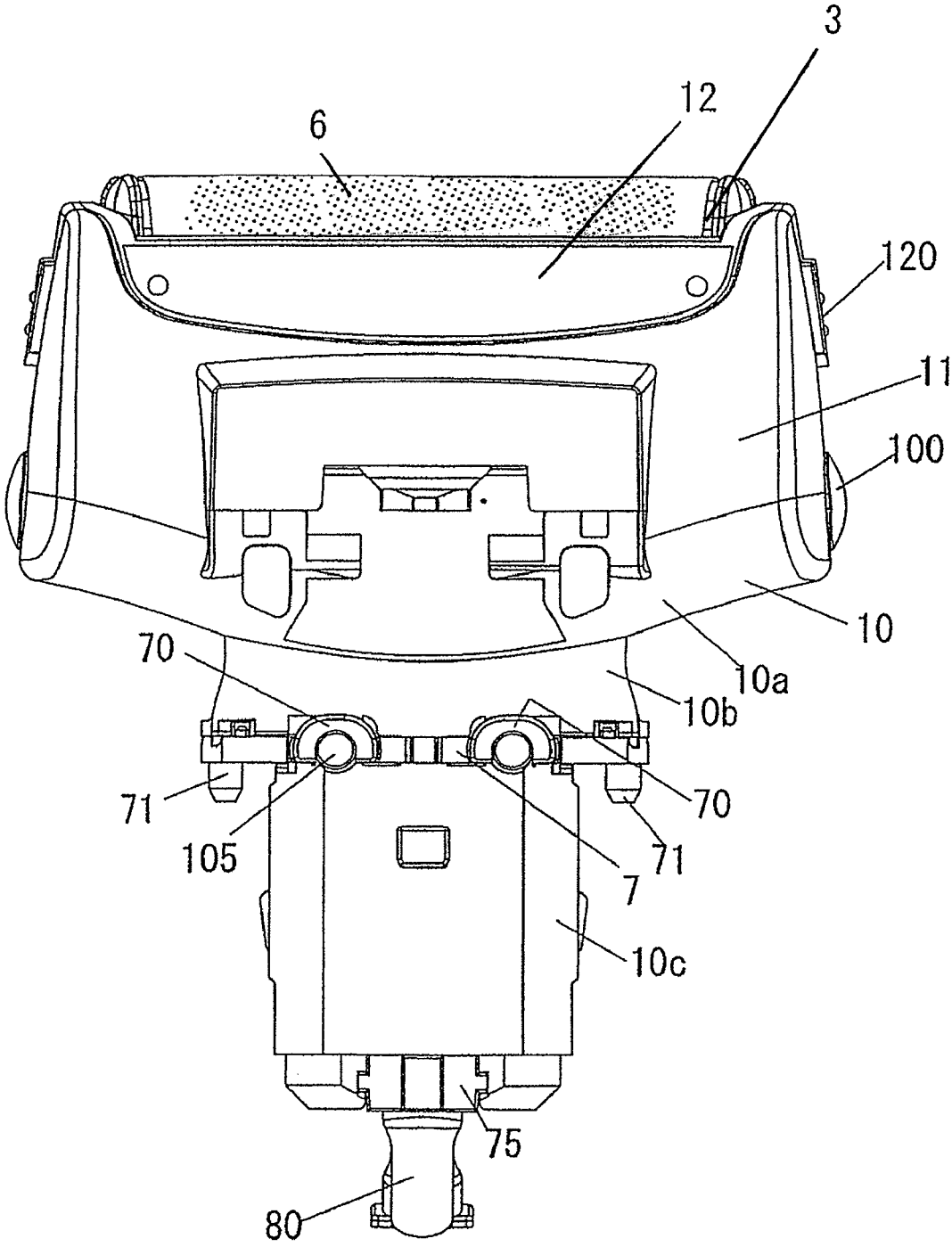
FIG. 7 is a rear view of the head portion.

The contact portion 75 projects from the detent member 9. The detent member 9 is inserted into the accommodating body 10*c* from a direction (right side in FIG. 2) perpendicular to a sliding surface of the contact portion 75 and a hook portion on a tip end of the detent member 9 is retained to the base portion 10, thereby sandwiching and fixing the end of the waterproof tube 80 between the base portion 10 and the detent member 9. In the mounted state, the detent member 9 is always pressed by the contact portion 75 in a direction in which the detent member 9 is pulled out. Therefore, it is possible to prevent a part from falling by an impact at the time of falling and during long term usage. A window 210 (see FIGS. 2 and 11) brings the opened space 26 and an outer surface of the housing 21. A user can observe, through the window 210, the state of the waterproof tube 80 from outside when the housings 21 and 22 are combined. The window 210 also functions to discharge water which enters the opened space 26.

The head portion 1 can not only vertically move but also laterally tilt with respect to the main body grin portion 2. This is because, if the gap between an open edge 20 at the opened space 26 of the main body grip portion 2 through which the head portion 1 is inserted and the neck portion 10*b* which is to be located on the inner peripheral side of the open edge 20 in the head portion 1 is not sufficiently large, the tilting motion of the head portion 1 is impaired. If the gap is excessively large, dusts such as shaved beard or moustache are prone to enter the opened space 26 of the main body grip portion 2 from this gap.

Figure 9:
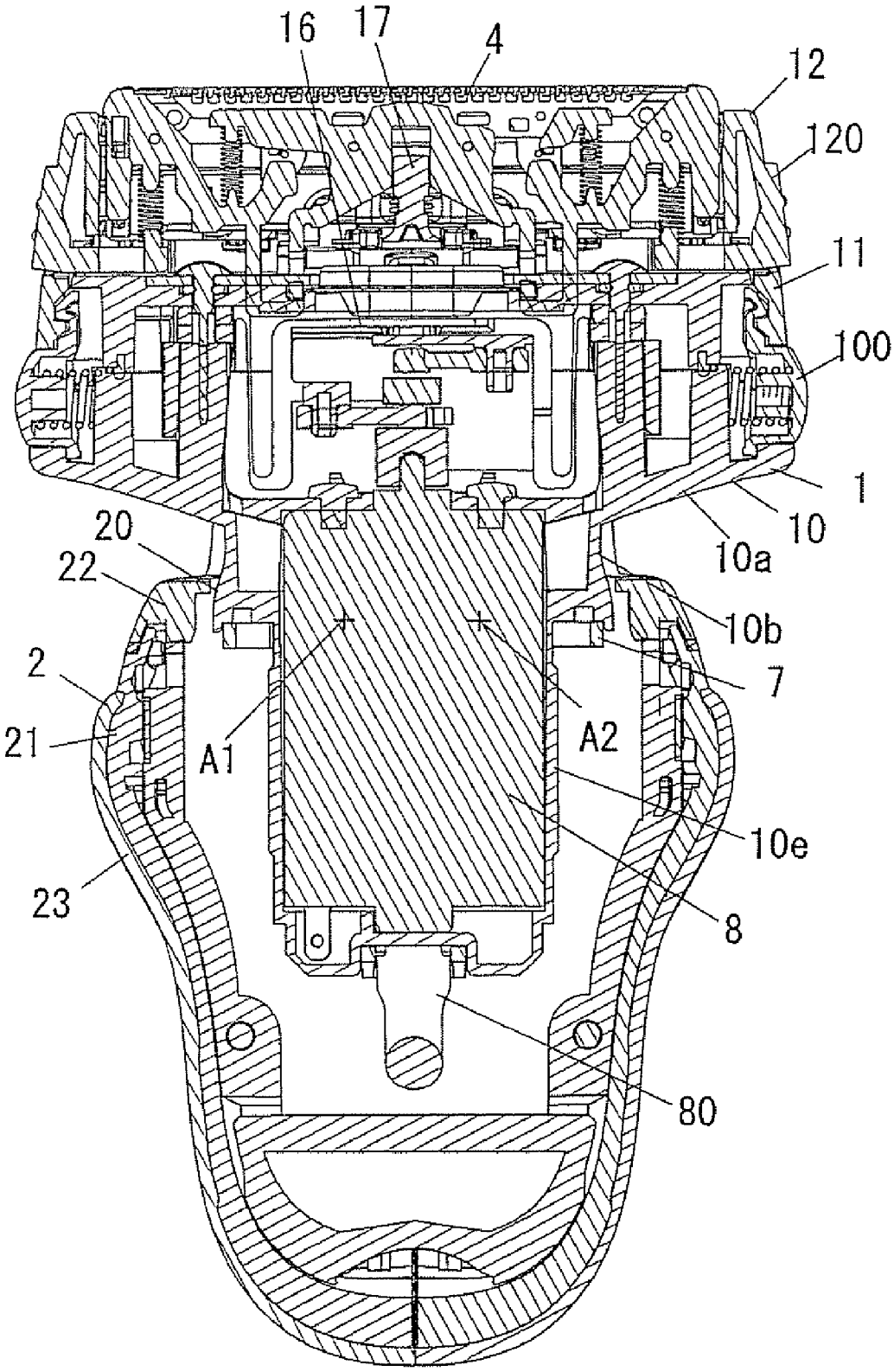
FIG. 9 is a sectional view taken along the line C-C in FIG. 4.
Figure 10:
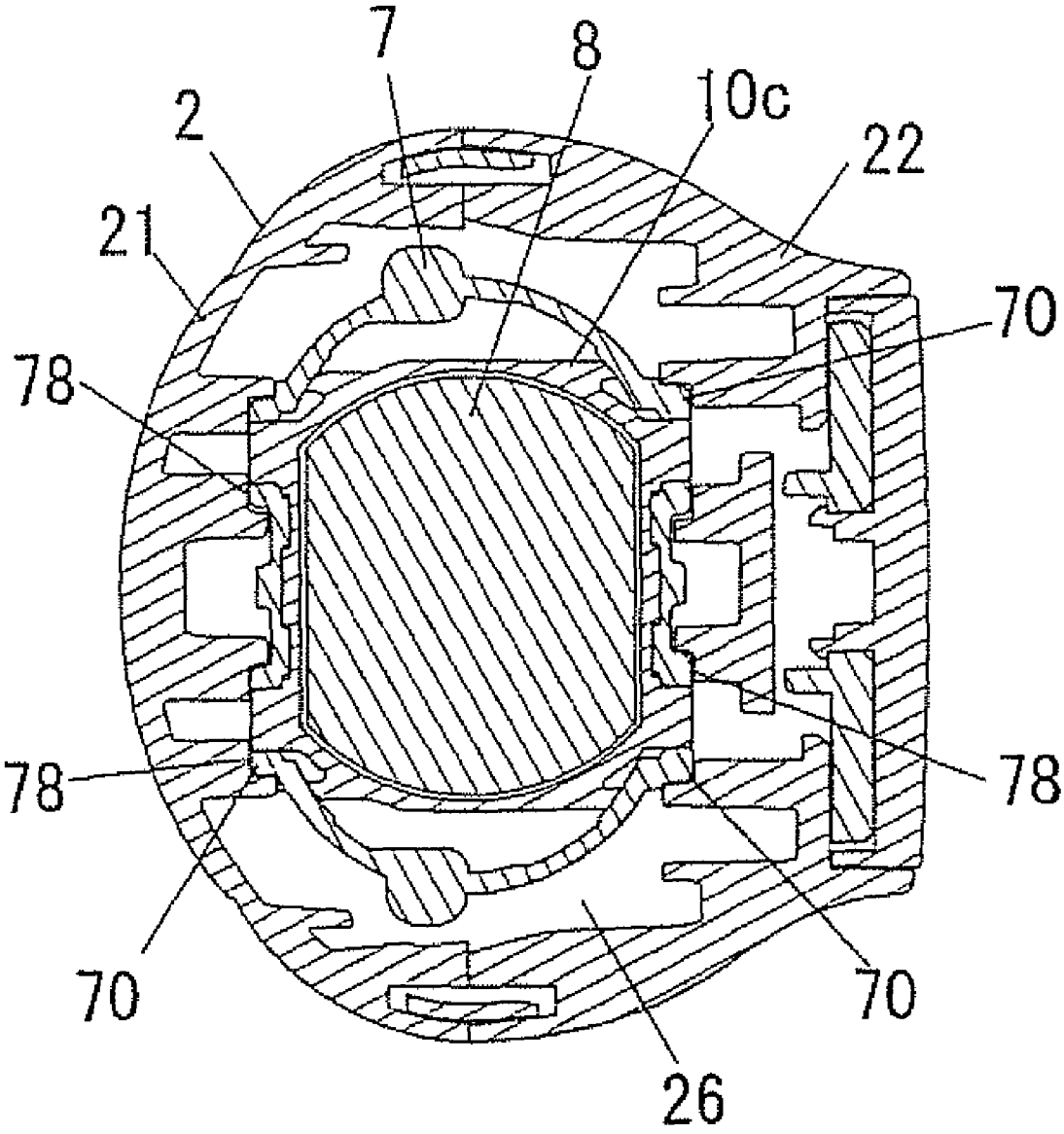
FIG. 10 is a sectional view taken along the line D-D in FIG. 4.

For this end, the left and right shaft portions 70 and 70 which are rotational axes A1 and A2 (see FIG. 9) of lateral tilting motion are located lower than the open edge 20. In this configuration, if the neck portion 10*b* has a constant diameter, the gap becomes a maximum when the head portion 1 does not sink. In view of this fact, the neck portion 10*b* is tapered from its lower side toward the upper side. With this configuration, when the head portion 1 sinks straightly, the gap between the open edge 20 and the neck portion 10*b* is increased, but there is no problem because the main motion of the head portion 1 when a user grasps the main body grip portion 2 and pushes the head portion 1 against her or his skin is to slightly tilt in left or right side.

According to the hair cutting device of the embodiment, the head portion 1 comes into slide contact with the front housing 21 of the main body grip portion 2 at three portions on the front surface of the accommodating body 10*c*, i.e., the pair of shaft portions 70 and 70 and the contact portion 72, and comes into slide contact with the rear housing 22 of the main body grip portion 2 at three portions on the rear surface of the accommodating body 10*c*, i.e., the pair of shaft portions 70 and 70 and the contact portion 75. Therefore, the head portion 1 is stably supported in the front-rear direction, and noise is suppressed. In addition, the head portion 1 and the main body grip portion 2 come into direct contact with each other through the three front portions and the three rear portions, and no special member is not interposed therebetween. Therefore, the number of parts can be reduced, this facilitates the assembling operation and the cost can be reduced.

According to the present invention, in the hair cutting device, the head portion is connected to the upper portion of the main body grip portion such that the head portion can laterally tilt and vertically move, the head portion is stably supported in the front-rear direction, noise is suppressed, the number of required parts is small, and the cost is suppressed.

What is claimed is:

1. A hair cutting device comprising:

a head portion, an outer blade formed with a plurality of blade holes, an inner blade that slidably contacts an inner surface of the outer blade, and a motor which drives the inner blade, wherein the head portion is connected to an upper portion of a main body grip portion having a controller such that the head portion can laterally tilt and vertically move, the head portion is resiliently biased upward, wherein an upper end of the main body grip portion is formed with an opened space into which a lower portion of the head portion is inserted, wherein both front and back surfaces of the head portion have a pair of left and right shaft-bushing portions provided by an annular member, which are connected to an inner surface of the opened space of the main body grip portion such that the left and right shaft-bushing portions can laterally rotate relative to the main body grip portion, vertically move relative to the main body grip portion, and slidably contact the inner surface of the opened space, wherein a contact portion which is provided lower than the pair of left and right shaft-bushing portions and slidably contacts the inner surface of the opened space, wherein the annular member is mounted on an outer surface of the lower portion of the head portion, wherein the pair of left and right shaft-bushing portions respectively provided on both front and back surfaces of the annular member are supported by a bearing formed on the inner surface of the opened space of the main body grip portion such that the left and right shaft-bushing portions can laterally rotate and vertically move, and wherein spring receivers are respectively provided on left and right ends of the annular member to receive push-up springs which resiliently bias the head portion upward.

2. The hair cutting device according to claim 1, wherein the lower portion of the head portion is formed as a box-like accommodating body in which the motor is accommodated, the pair of left and right shaft-bushing portions are disposed on an upper end of the accommodating body, and the contact portion is disposed on a lower end of the accommodating body.

3. The hair cutting device according to claim 2, wherein the head portion and the main body grip portion have waterproof structures which are independent from each other, a through hole formed in the accommodating body of the head portion and a through hole formed in the opened space of the main body grip portion are water-tightly connected to each other through a waterproof tube, a wire for electrically connecting the motor in the accommodating body of the head portion and the controller in the main body grip portion with each other is inserted into the waterproof tube, and the contact portion provided on at least one of the front and back surfaces of the head portion is integrally formed together with a detent member of the waterproof tube.

4. The hair cutting device according to claim 3, wherein the detent member is inserted into and fixed to the accommodating body in a direction perpendicular to a sliding surface of the contact portion.

5. The hair cutting device according to claim 1, wherein the left and right shaft-bushing portions and the contact portion provided on the head portion are made of a material different from a material of the opened space of the main body grip portion.

6. The hair cutting device according to claim 1, wherein the left and right shaft-bushing portions are generally cylindrical and extend from the head portion to connect to the inner surface of the opened space of the main body grip portion.

7. The hair cutting device according to claim 6, wherein the left and right shaft-bushing portions are each configured to rotate about a rotational axis thereof in which the rotational axes are orthogonal to the inner surface of the opened space of the main body grip portion.

* * * * *